US005103808A

United States Patent [19]

Iams et al.

[11] Patent Number: 5,103,808

[45] Date of Patent: Apr. 14, 1992

[54] DEVICE FOR MANIPULATING THE SPINE

[75] Inventors: John F. Iams, Poway; Robson L. Splane, Jr., Granada Hills, both of Calif.

[73] Assignee: Superspine, Inc., Poway, Calif.

[21] Appl. No.: 434,088

[22] Filed: Nov. 9, 1989

[51] Int. Cl.[5] ..... A61H 7/00

[52] U.S. Cl. ..... 128/52; 128/54; 128/55

[58] Field of Search ..... 128/33, 52, 51, 54, 128/55, 57, 53

[56] References Cited

U.S. PATENT DOCUMENTS

| | | | |
|---|---|---|---|
| 3,039,458 | 6/1962 | Hill | 128/52 X |
| 3,640,272 | 2/1972 | Hussey | 128/57 X |
| 4,085,738 | 4/1978 | Kodera | 128/52 X |
| 4,192,296 | 3/1980 | St. Mary | 128/52 |
| 4,230,098 | 10/1980 | Uematsu | 128/52 X |
| 4,458,675 | 7/1984 | Nakao et al. | 128/52 |
| 4,656,998 | 4/1987 | Masuda et al. | 128/52 X |
| 4,662,362 | 5/1987 | Masuda et al. | 128/33 |
| 4,760,841 | 8/1988 | Holler | 128/33 X |
| 4,947,833 | 8/1990 | Yamasaki | 128/52 |

*Primary Examiner*—Edgar S. Burr
*Assistant Examiner*—Moshe Cohen
*Attorney, Agent, or Firm*—Stanley A. Becker; Frederick W. Pepper

[57] ABSTRACT

A machine applies a cyclic localized thrusting force against the back of a patient recumbent upon his or her back on a support bed in order to manipulate the user's back or spine. Several (typically three) spaced-apart thruster members reciprocate between a first position retracted into the support bed below its top surface and a second position thrusting into pressured contact with the patient's back. The reciprocal thrusting is variable and controllable in real time with respect to the locations, areas, patterns of contact, amplitude, frequency, numbers of cycles, pressure, and number of separate sites. Spinal therapy normally performed by a human therapist may correspondingly be comprehensively mechanically replicated.

28 Claims, 4 Drawing Sheets

FIG. 3
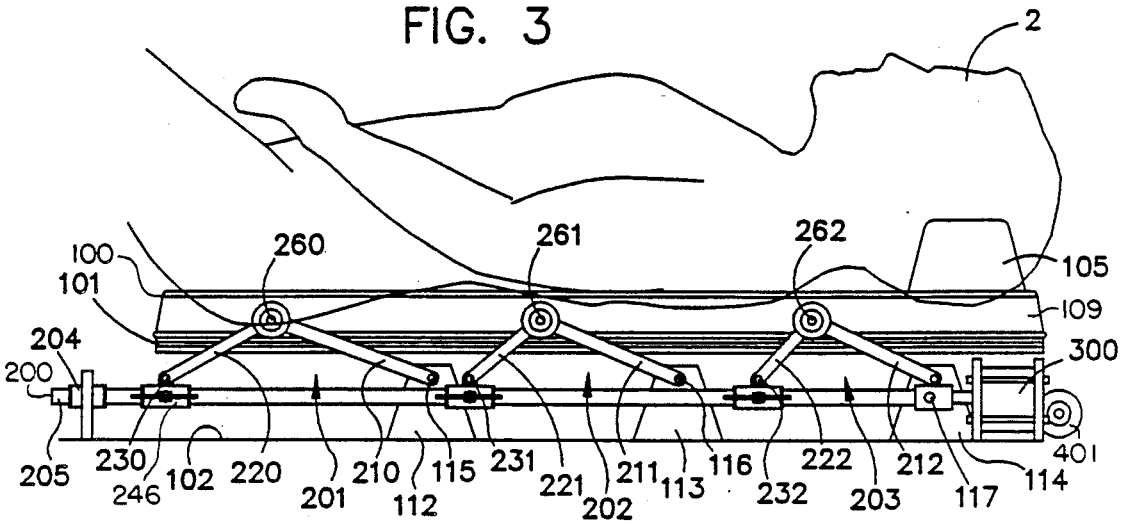
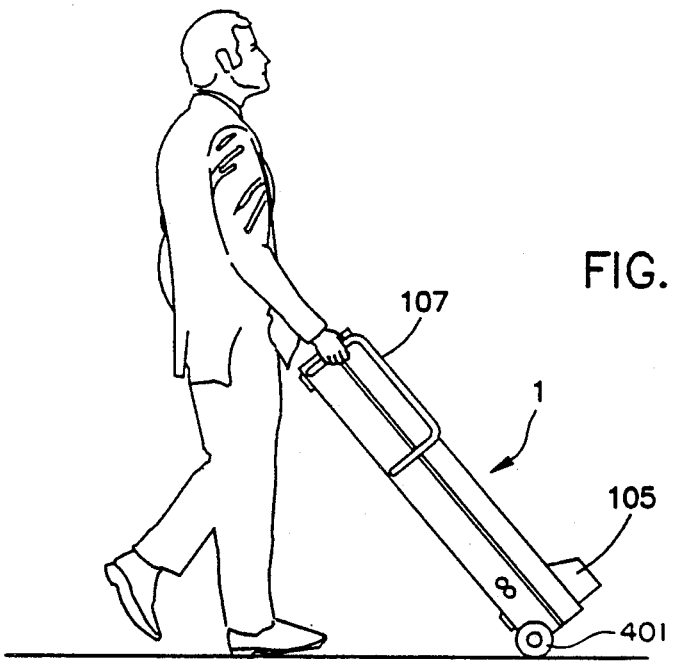
FIG. 6

DEVICE FOR MANIPULATING THE SPINE

BACKGROUND OF THE INVENTION

1. Field of the Invention

The present invention concerns therapeutic devices for manipulating the human spine, including devices for manipulating the spine in its lumbar, thoracic, and cervical regions.

2. Background of the Invention

It is known to manipulate the human spine for therapeutic purposes by use of machines. The human spine and spinal muscles may be either active or passive during the course of machine manipulations.

Such manipulation may be on a large scale where extensive regions of the spine are bent, stretched, or otherwise subjected to external forces and pressures. The manipulations may alternatively be on a small scale wherein localized forces are applied to small areas of the spine, such as to a single vertebrae. Small scale manipulations of the human spine provide therapy for spinal dysfunction, spinal pain, or to exercise the spine and improve its performance. Equipment for performing localized spinal therapy is typically found in hospitals, doctor's offices, and reconstructive therapy centers.

Several requirements are common to many forms of spinal manipulation. Most of these requirements are met by a human spinal therapist who uses his or her hands and muscles to manipulate the patient's spine while using his or her sense of hearing, sight and touch to assess feedback from the patient regarding the effects of the manipulations.

It is more difficult to meet the requirements of spinal manipulation with a machine. It would be useful to do so, however, in order to reduce the costly human services of a physical therapist. Manipulation of the spine with a machine is also desirable due to the often high and prolonged forces applied to the patient that can cause fatigue in a human therapist.

A machine for manipulating the spine should always manipulate a patient's spine with consideration for the patient's therapeutic requirements and physical comfort. The patient should receive only those particular manipulations that the patient requires and the manipulations should never induce or aggravate an injury and should not be painful.

Accordingly, a machine for manipulating the human spine would preferably be versatile in the nature of the manipulations performed and fully adjustable during the performance of these manipulations. The functional flexibility of the machine is important so that the machine may perform the particular spinal manipulations that are individually required by a particular patient. The adjustability of the machine is important during the therapy of spinal dysfunction wherein ongoing machine manipulations may induce pain or injury to the patient. Upon any such adverse occurrences it is necessary that the patient, especially one who is substantially immobile relative to the machine, should be in complete control of the machine, and should be able to halt or otherwise control the manipulations.

A machine for manipulating the spine should also preferably be able to target specific spinal locations where manipulations are to be performed. At each targeted location, it is preferable that the size of the spinal area manipulated by the machine be adjustable. The location, pattern, amplitude, and amount of force applied within each area should also be adjustable. For example, a preferred location and pattern of force application by a human physical therapist can be examined to help define the requirements for machine manipulation. A physical therapist commonly manipulates localized regions of a patient's back proximate to selected spinal vertebrae, such as regions adjacent the lumbar, thoracic, or cervical vertebrae. The physical therapist commonly applies treatment to one or more areas which are each roughly the size of the therapist's fingertips. One common pattern of therapeutic manipulation used by a physical therapist is implemented by placing one finger upon each side of a spinal vertebrae and pressing. The amplitude and degree of force applied is determined by the muscular exertions of the therapist. The therapist uses his or her judgment and sensations of displacement and pressure to determine how much amplitude and pressure to apply and to know whether, and how, to continue with the spinal manipulations.

A machine for manipulating the human spine should be further adjustably controllable in the frequency and angles at which the spinal manipulations are performed. The typical manipulations by a human physical therapist may again be examined. It is common for the therapist to engage in a cyclical thrusting, or pressing, motion against, or proximate to, one or more spinal vertebrae. The motion is typically reciprocal, involving a thrusting application of pressure to the spine and a subsequent relief of this pressure. The thrusting motion is typically conducted for many dozens or hundreds of cycles at rates ranging to several cycles per minute. The thrusting motion is preferably done within a range of predetermined angles. These angles are typically chosen by the therapist in consideration of the particular spinal region is being manipulated. The angle and frequency of the thrusting manipulations are both controlled by the therapist.

A machine for manipulating of the spine would advantageously provide simultaneous coordinated manipulations at more than one spinal location. Simultaneous manipulations at multiple spinal locations desirably permit the spinal region between the manipulated locations to be beneficially affected. For example, if a thrusting motion is made against a few spinal vertebrae at each of two locations that are separated by several intervening spinal vertebrae, then a bending of the spine will be induced. This bending affects the intervening spinal vertebrae. This ability to bend or stretch a length of spinal vertebrae may be as therapeutic as the application of thrusting stimulation directly to such vertebrae.

A machine for manipulating of the spine would preferably be constructed to administer well established therapeutic and exercise regimens. The machine would desirably manipulate the spine only in manners that simulate spinal manipulations produced by a trained physical therapist. A trained spine manipulator would desirably be able to easily and directly control the machine, and also be able to instruct a patient to use the machine in a manner that duplicates manual therapeutic manipulation of the spine.

Machine simulation of all the variable and mechanically sophisticated parameters that characterize manual manipulation of the spine by a trained therapist thus becomes a task of considerable complexity.

SUMMARY OF THE INVENTION

The present invention contemplates machine manipulation of the spine of a patient who is recumbent upon his or her back. The machine manipulates the back and/or spine of the patient by cyclically applying a thrusting force against localized regions of the patient's back, and particularly against the spinal region of the patient's back.

A preferred embodiment of an apparatus of the present invention includes a support bed that presents a substantially level surface upon which a user lies recumbent on his or her back. One or more thruster members reciprocate relative to the support bed's surface. An upwardly disposed operative region of each thruster member is suitably configured to contact a small region of the user's back, typically a small region localized around one or more spinal vertebrae. Each thruster member reciprocates between a first position where its operative region is retracted at least partially below the top surface of the support bed, and a second position where the thruster's operative region extends upwards at least partially above the top surface of the support bed and presses against the small region of the patient's back sufficiently so as to manipulate the patient's back without displacing the patient from the support bed.

The present invention further contemplates that the machine manipulation of the human back is variable, predeterminable and controllable in real time during machine operation, in a great number of parameters characterizing the manipulation. The predetermination and control of manipulation parameters permit the manipulations performed by the machine to be both optimal and non-injurious to a patient.

In accordance with the present invention, the location, area, pattern of contact, amplitude, frequency, number of cycles, pressure, angle, and number of separate manipulation sites may be variably predetermined and/or variably controlled.

The location for each manipulation is predeterminable and controllable because the support bed upon which the patient lies is movable in a level plane relative to the one or more thruster members that reciprocate relative to the level surface of the support bed.

Both the area and the pattern of contact by which thrusting forces are applied to the patient's back are predetermined by the physical configuration of the operative region of the thruster member. This operative region is typically sized and adapted to contact only a small portion of the recumbent patient's back, and is more typically sized and adapted to contact an area of the patient's back between two adjacent, or spanning one, vertebrae of the spine. A particular preferred pattern of localized application of thrusting force is implemented by providing two parallel spaced contact surfaces that have sufficient separation so as to permit each surface to contact an alternate side of one spinal vertebrae. Each contact surface is preferably an arcuate segment of a toroid. The area of the arcuate segment is roughly the area of a human fingertip. Accordingly, the preferred contact area and pattern of the contact surface closely mimic the area and pattern of the index and middle fingers of a human hand as such fingers are used in spinal therapy.

The amplitude and frequency of the cyclic thrustings are individually predeterminable and, to a lesser extent, controllable by the user. In order to accomplish this predetermination and control, the preferred embodiment of each thruster member includes one or more three-leg mechanical linkages in a triangular shape (but not rigidly connected as a triangle). Each thruster member is constructed as a positionally reciprocating plunger, such as a plunger of the solenoid or pneumatic types. A first leg of each mechanical linkage positionally pivots about a first vertex point that is fixed relative to the support bed and to a patient recumbent thereon. A second vertex point, connecting a second and third leg of each mechanical linkage, positionally oscillates between greater and lesser proximity to the first vertex point. The second vertex point so oscillates under force of a linearly reciprocating drive shaft. This drive shaft constitutes the second leg of the mechanical linkage. The mechanical linkage's first and third legs are pivotably connected at a third vertex point to thereby form the operative region of the thruster member. This operative region reciprocates relative to the top surface of the support bed in order to provide the thrusting force against the user's back.

Predetermination and control of the amplitude of the thrusting force is accomplished by adjusting the amplitude of the linear reciprocation of the drive shaft. The linearly reciprocating drive shaft is preferably powered by a fluid cylinder that is in turn powered by a fluid pump. The amount of fluid that is displaced by each cycle of the pump relative to the capacity of the fluid cylinder determines the amplitude of the drive shaft's motion, and thus also the amplitude of the thruster member's reciprocating motion. There is also a small effect on amplitude due to a variably predetermined connection of the third leg of the thruster member linkage to its reciprocating drive shaft second leg. Although the fluid capacities, mechanical displacements, and thrusting amplitude are primarily predetermined, fluid may be bled into a low pressure side or from a high pressure side of the pump during operation to fine adjust the thrusting amplitude.

The frequency of the thrusting force is both predeterminable and controllable by adjustment of the frequency of reciprocation of the drive shaft. This rate is determined by machine fluid capacities relative to the rate at which the fluid pump is cycled. The pump is preferably electric, and its pumping rate is determined by the variable application of electric power.

The period of time over which the pump is permitted to run at a given rate ultimately determines the total number of thrusting cycles that are applied to the user's back.

The pressure, or force, of the thrusting is partially determined by the amplitude of the thrusting: a larger amplitude produces a higher force against the patient's recumbent body. However, pressure is also separately predeterminable. The patient may be strapped to the support bed, or bear weights upon his or her body, to reduce uplifting due to mechanical thrustings against the patient's back, and to correspondingly increase the pressure resulting from such thrustings. Additionally, the type of fluid that is used within the fluid cylinder may be either compressible (e.g., air), or may be substantially incompressible (e.g., oil). The pressure of such fluid may be adjusted by varying the strength of the pump. A powerful pump and an incompressible fluid can exert very strong pressure forces against a patient's back. More commonly, a pump of modest power using air as a working fluid produces reciprocal mechanical thrustings that are moderately strong but not so strong that the reciprocal thrusting member cannot be strongly mechanically resisted in its motion, or even forcibly held motionless, without breaking the machine or injuring the user.

The operative region of the thruster member, located at the third vertex point of the triangularly shaped mechanical linkage, reciprocally thrusts against the user's back in a straight line path. In accordance with the invention, the angle of this path relative to the axis of the user's spine may be variably predetermined. This is accomplished by a variable connection of the third leg of the mechanical linkage to the second leg drive shaft. Certain particular thrusting angles of 70°, 60°, and 45° off the spinal axis, that are respectively suitable for applying pressure to the lumbar, thoracic, and cervical regions of the spine, may be predetermined.

The same mechanism that provides the variably predetermined attachment between the second and third legs of the mechanical linkage also permits these legs to be mechanically decoupled, causing the reciprocating movement of the third vertex operative region to stop. This decoupling is controllable by the user and functions as an emergency stop mode for the machine. During an emergency stop, a thruster member will never be left in an extended position contacting the patient's back. The retraction of the thruster member upon an emergency stop eliminates the possibility that pain would be continuously induced in the patient by a thruster member extended into contact with the patient's back.

The number of separate sites at which forcible thrusting against the patient's back transpires is variably predeterminable. In the preferred embodiment of the present invention, from one to three sites may be selectively enabled for thrusting. Coordinated, normally simultaneous, manipulation of a patient's back is performed at the sites. The three sites are typically located at the lumbar, thoracic, and cervical regions of the patient's spine. Each site is individually enabled or disabled for the production of thrusting forces by coupling or uncoupling the third leg of the mechanical linkage thruster mechanism from the drive shaft second leg. When two adjacent thrusters of the apparatus are both enabled for simultaneously generating thrusting forces, then the receipt of these thrusting forces at adjacent localized areas of the patient's spine is typically sufficient to bend and stretch the patient's intervening spinal region. The coordinated operation of two or more thrusting members thereby produces manipulations of the spine that would not be possible with one thruster member acting alone.

These and other aspects and attributes of the present invention will become increasingly clear upon reference to the following drawings and accompanying specification.

BRIEF DESCRIPTION OF THE DRAWINGS

FIG. 3 is a cross sectional side plan view of the device for manipulating the spine.

FIG. 6 is a pictorial view showing transport of the device of manipulating the spine.

Like reference numbers in the various drawings refer to like elements.

DETAILED DESCRIPTION OF THE INVENTION

Figure 1:
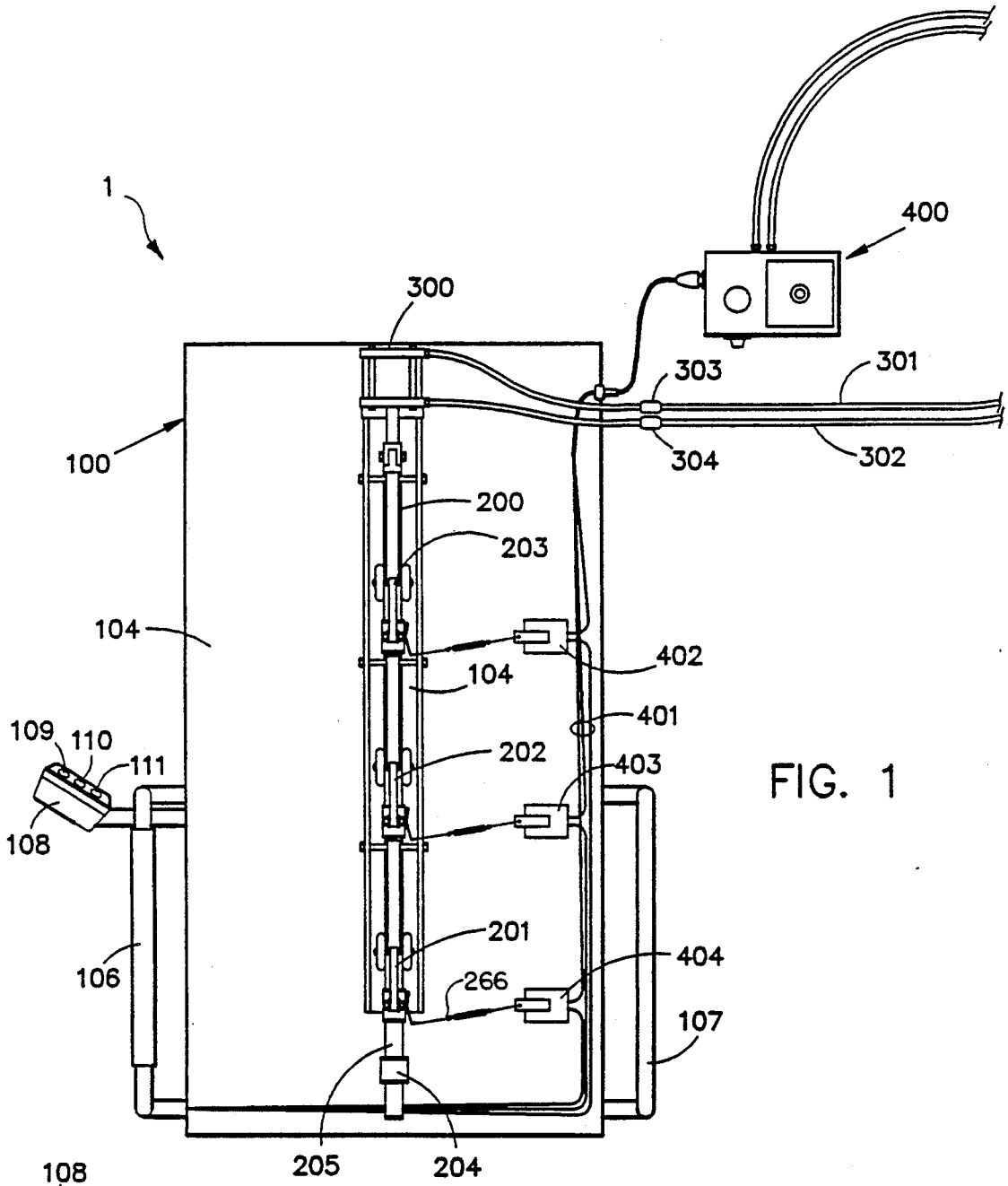
FIG. 1 is a top plan view, partially in cross section, of the preferred embodiment of a device for manipulating the spine in accordance with the present invention.

A preferred embodiment of a device of the present invention for manipulating the back of a patient recumbent upon his or her back is generally shown in FIGS. 1–6. The preferred embodiment of the manipulation device 1 shown in FIG. 1 includes a support bed 100 upon which a patient lies recumbent (most clearly illustrated in FIG. 3), a reciprocating thruster assembly 200 for providing reciprocating thrusting forces against the back of the recumbent patient 2 (FIG. 3), a fluid cylinder 300 for providing actuation force to the thruster assembly 200, and a pump 400 for cyclicly providing pressurized fluid to fluid cylinder 300. The purpose of the manipulation device 1 is to reciprocally apply thrusting forces to the back, and particularly to the spine, of the patient 2 who is recumbent upon the top surface of the manipulation device 1. The manipulative thrusting movements and forces produced by the manipulation device 1 are particularly useful in therapy for spinal dysfunction, for relief of pain, and for general exercise of the spine. The manipulations performed on patient 2 by the manipulation device 1 are highly regularized and controllable, as hereinafter explained.

The support bed 100 has a generally horizontal, generally planar upper frame 101 (FIG. 2) that is movably supported above a lower frame 102, typically by a slide or roller assembly, (shown as rollers 103). Movement between the upper frame 101 and the lower frame 102 is preferably constrained to be principally along a longitudinal axis to the manipulation device 1, but some small amount of lateral movement is typically also enabled. The rollers 103 roll within troughs located on the upper frame 101 and the lower frame 102 so as to permit relative movement between the rectangular frames 101 and 102 in a longitudinal direction, and, to a small extent, in the lateral direction. This relative movement permits the recumbent patient 2, (visible in FIG. 3) to selectively position various portions of his or her back and spine over reciprocating thruster members 201–203. In order to do so, the patient typically requires a considerable amount of longitudinal positional adjustment and much less lateral positional adjustment. These adjustments are made possible by the structure of the upper frame 101 over lower frame 102 on the rollers 103.

The upper frame 101 supports a generally flat cushion, or pad, 104. The cushion 104 has a resilient surface upon which the patient 2 may comfortably rest. It is typically removable and washable, and is normally made from vinyl covered foam rubber.

The cushion 104 is partially shown in cutaway at the top left to lower left side of FIG. 1 in order that the fluid cylinder 300, a portion of the fluid pressure lines 301 and 302, the wiring harness 401, the solenoids 402–404, the control panel 108, and the bearing 204 which supports a drive shaft 205 (both part of reciprocating thruster assembly 200) may be better observed.

Figure 2:
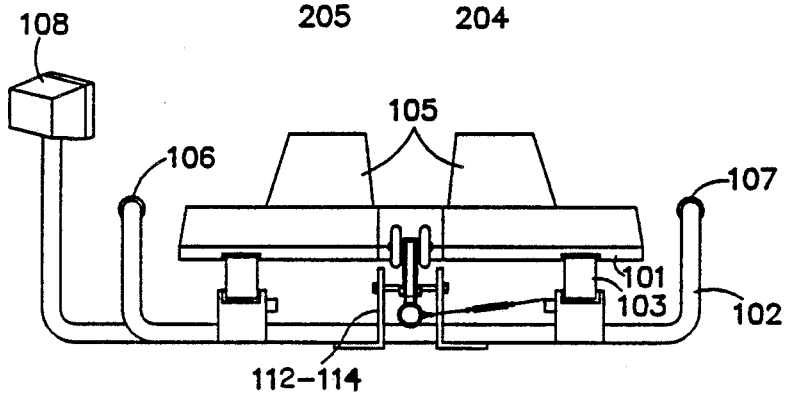
FIG. 2 is an end plan view of the device for manipulating the spine.

The cushion 104 generally covers the entire top of upper frame 101. It does, however, have a substantially central elongate aperture 120. It is through this aperture 120 that the operative regions of thruster members 201–203 (most clearly seen in FIG. 3) extend in order to contact the back of patient 2 (shown in FIG. 3) recumbent on the cushion 104. A headrest 105 (as shown in FIG. 2), typically formed integrally with cushion 104, comfortably supports the head of the patient 2.

The lower frame 102 has side rails 106 and 107 in positions along each side of the manipulation device 1 at the opposite end from fluid cylinder 300 and headrest 105. The side rails 106 and 107 are conveniently located in positions whereat the recumbent patient 2 (shown in FIG. 3) may use them to facilitate lying down onto and arising from the cushion 104 and the manipulation device 1.

A control panel 108 is conveniently located next to side rail 106 that is positioned at the right hand of the patient 2. The control panel 108 typically has ON, OFF, and EMERGENCY STOP pushbutton switches 109–111. These switches 109–111 connect through wiring harness 401 to pump 400 and solenoids 402–404. The ON pushbutton switch 109 enables a supply of AC electrical power (source not shown) to pump 400 while the OFF switch 110 disables the supply of power. The EMERGENCY STOP pushbutton switch 111—which may be prominently located, sized or colored as desired—not only switches off AC power to pump 400 but causes solenoids 402–404 to release. The release of the respective solenoids 402–404 disengages the drive shaft 205 from the respective thruster members 201–203. When so disengaged neither a motive force nor a static force provided by fluid cylinder 300 is coupled to the thruster members 201–203. The thruster members 201–203 use the motive force provided by fluid cylinder 300 to produce thrusting forces against the back of patient 2. The EMERGENCY OFF switch 111 thus not only stops device 1 from manipulating the back of user 2, but also returns the manipulation device 1 to a neutral position where none of the thruster members 201–203 are extended and there is no substantially forceful contact with the back of patient 2.

The cross-section side plan view of FIG. 3 best shows the overall mechanical construction of the manipulation device 1. The lower frame 102 exhibits a plurality, typically three, support stanchions, or mounts, 112–114. These mounts 112–114 have at their upper regions a pivot joint 115 that serves to connect the lower frame 102 and respective ones of the reciprocating thruster members 201–203 of thruster assembly 200. The mounts 112–114 may be adjustable in position both longitudinally and laterally relative to lower frame 102, including by being fixed in position slightly off the longitudinal center line of lower frame 102.

The fluid cylinder 300 is also affixed to lower frame 102. It drives the drive shaft 205 in a linearly reciprocating motion. The drive shaft 205 is supported above lower frame 102 at one end by fluid cylinder 300 and at its other end by bearing 204.

The reciprocating thrusters 201–203 of the thruster assembly 200 serve to provide, under power derived from fluid cylinder 300, a linear reciprocating force to the back of patient 2. The detailed construction of a reciprocating thruster 201–203 is most clearly visible in FIG. 4. Each thruster 201–203 is preferably made from a mechanical linkage that is substantially triangular in shape. Each triangular linkage includes a first leg 210, a portion of the drive shaft 205 that serves as a second leg, and a third leg 220. A first "vertex" of each triangularly shaped linkage of each of the thrusters 201–203 is located at a pivot joint 115. This "vertex" is open, and is actually only a pivot joint that connects at one end of the first leg 210. Standoffs, or spacers, 213 are used in the pivotable connection of each leg 210 to a respective mount 112–114.

Figure 4:
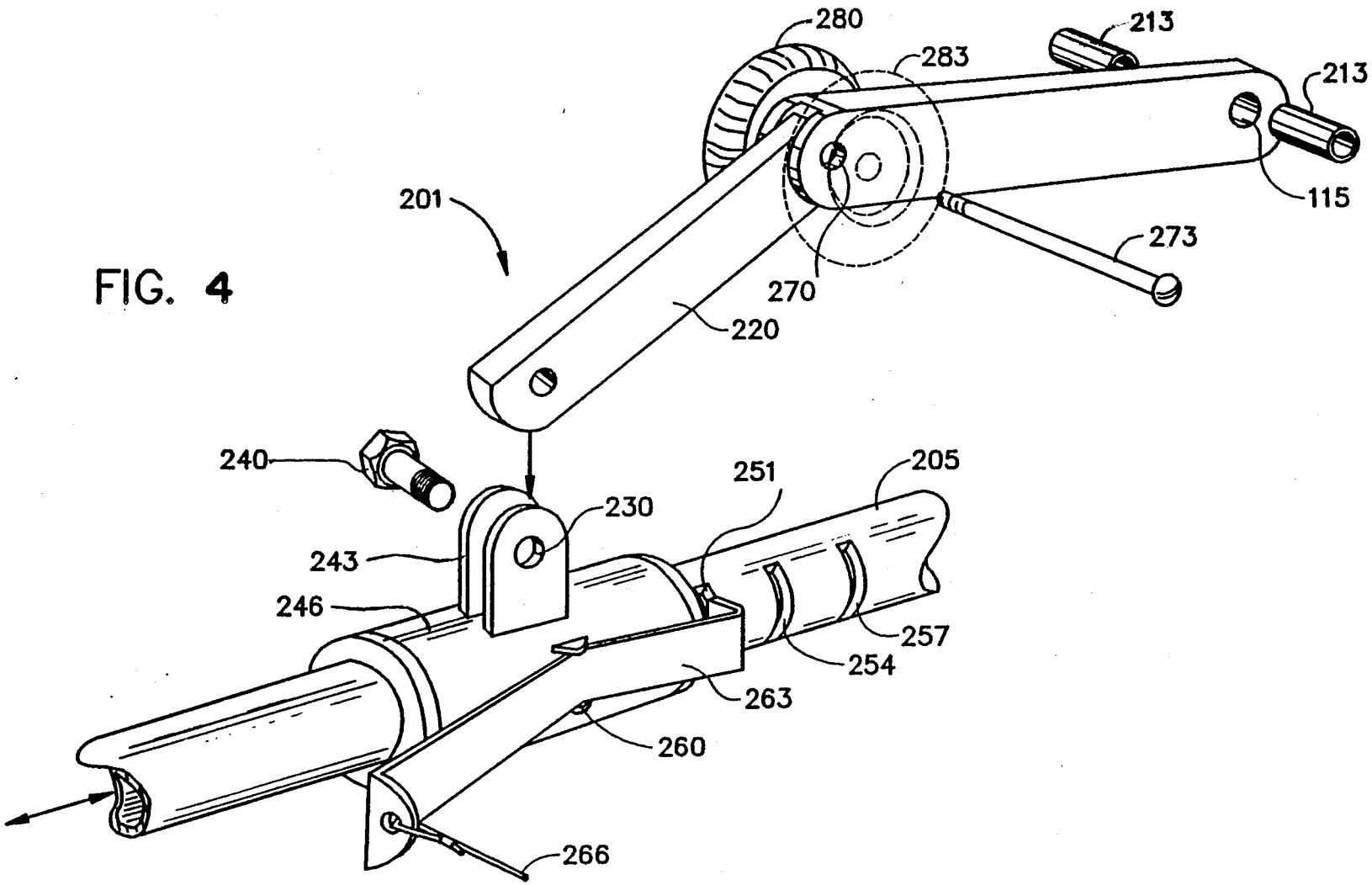
FIG. 4 is an exploded perspective view showing the mechanical linkage of the reciprocating thruster member within the device for manipulating the spine.

As shown in FIG. 4, a second vertex is located at a pivot joint 230 between third leg 220 and a portion of the drive shaft 205. Each such pivot joint 230 is preferably constructed from a respective bolt 240 that threads a complementary bore within a third leg 220, and a flange 243 to a bushing 246 that rides upon the drive shaft 205.

The drive shaft 205 has a number of relieved locations, typically in the shape of slots 251, 254, 257, that are respectively located proximate to a respective sliding bushing 246 of each of the respective thrusters 201–203. The bushings 246 are adjustably fixed to the drive shaft 205. On each sliding bushing 246 a spring-biased metal lever 263 is pivotally mounted around a pin 260. Under a pulling force exerted through a wire 266, each lever 263 is engaged with a respective one of the slots 251, 254 or 257.

A third pivot joint 270 to the triangularly shaped linkages of the thrusters 201–203 is located between the first leg 210 and the third leg 220. The third pivot joint 270 is established by a bolt 273 that threads a complementary bore within the ends of each of the first leg 210 and the second leg 220. The bolt 273 also affixes a pair of spaced parallel toroids, or non-rotating tires, 280, 283, at opposite sides of the members 210, 220.

A portion of the outermost arcuate surfaces of each toroid 280, 283 constitutes the operative region of the thruster members 201–203. The major exterior diameter and the cross sectional diameter of each of the toroids 280, 283 jointly determine the size of each of the two localized areas within which thrusting pressure will be applied to the back of user 2.

The separation between each pair of spaced-parallel toroids 280 and 283 may be individually selectively predetermined by the use of standoffs (not shown) but is limited by the width of aperture 104. Predetermination of the separation of the toroids permits partial tailoring of the pattern of thrusting contact, particularly in adjusting for the width of, and the amount of adipose tissue surrounding, a particular patient's spine.

The predetermined distances between the toroids 280 and 283 preferably permits that each pair of toroids may effectively manipulate the spine by applying pressure to both sides thereof simultaneously. The center planes of each pair of toroids 280, 283 are typically spaced parallel and separated by a predetermined distance. This distance is approximately 2 inches between the toroids 288, 283 that are located at the thoracic region of the spine that is manipulated by thruster 202. The center planes between the toroid pairs 280, 283 located at the cervical and lumbar regions of the spine are spaced about 1.5 inches. Various sizes, spacings, and numbers of the toroids 280–283 (and also various other solid bodies such as spheroids or toroid forks that present suitable surfaces), may be employed in providing operative surfaces suitable to specific therapeutic situations.

The fluid cylinder 300 (shown in FIGS. 1 and 3) is actuated by pressurized fluid provided by fluid pressure lines 301 and 302. The pressurized fluid is typically compressed gas and is more typically compressed air.

Depending upon the volume of fluid that is pumped in each cycle relative to the internal capacities of air cylinder 300, the drive shaft 205 will be caused to move a variable amount. The fluid pressure lines 301 and 302 respectively incorporate in-line bleeder valves 303 and 304. The bleeder valves 303 and 304 are typically (but not necessarily) one-way valves which may either vent fluid into or out of the associated pressure lines 301 and 302. An inward venting of fluid may transpire during that portion of each pumping cycle when the pressure line has a negative pressure (less than ambient), and an expulsion of fluid may transpire during the opposite, pressured, portion of the pumping cycle. The pumping cycle is normally so slow (on the order of ten seconds) that casual experimentation will allow a user to learn how to bleed a variable amount of fluid into each side of the dual pressurized system, and to correspondingly control (to some extent) the retracted and upthrusted positions of the thruster members 201-203.

The reciprocal movement of drive shaft 205 acts through the triangularly shaped mechanical linkages of the thrusters 201-203 to induce a reciprocal linear thrusting movement at the operative region of each such thruster 201-203. This linear reciprocal thrusting movement is alternately towards, and away from, the back of the patient 2. The angle of this thrusting force is variable for each of the thrusters 201-203 by varying the lengths of the members 210 and 220. The thrusting amplitudes are substantially predetermined by which one of the slots 251, 254, and 257 upon drive shaft 205 is engaged by each of the levers 263 that are respectively part of the thrusters 201-203. The locations of all slots 251, 254, 257, and the lengths of the legs 210 and 220 of the triangular-shaped linkages of all the thrusters, are typically established in a relationship so that thrusting at and by each thruster 201-203 may occur at several different predetermined thrusting angles. In the illustrated embodiment, these thrusting angles are nominally 45°, 60°, and 70°. These three angles are respectively particularly suitable for application of thrusting forces to the cervical, thoracic, and lumbar regions of the spine of the user 2.

Figure 5A:
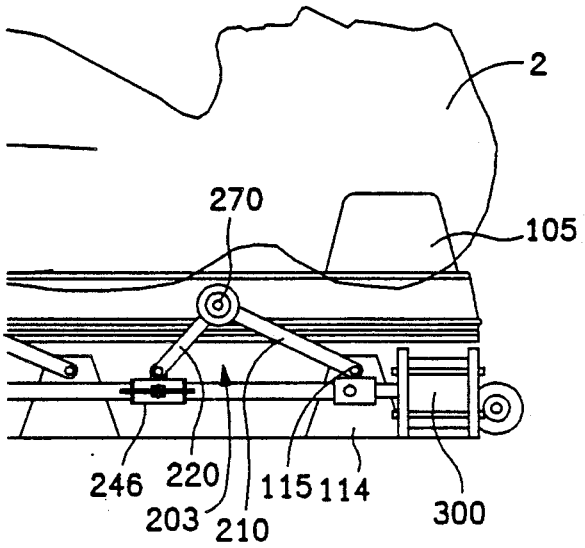
FIG. 5*a* is an enlarged portion of the same cross sectional side plan view shown in FIG. 3 showing the retracted mechanical position of the device for manipulating the spine.
Figure 5B:
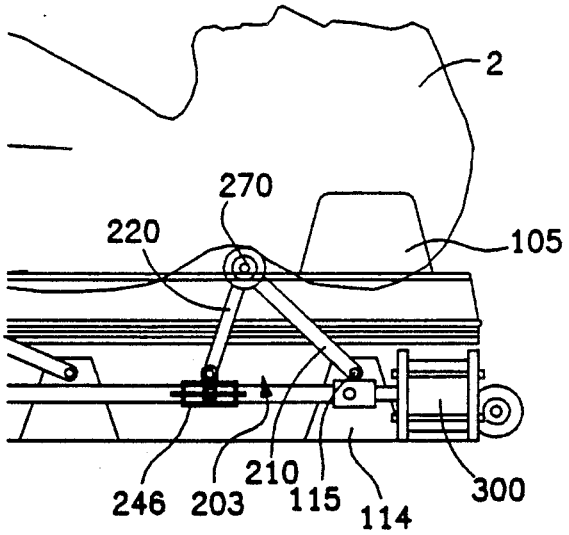
FIG. 5*b* is an enlarged portion of the same cross sectional side plan view shown in FIG. 3 showing the extended mechanical position of the device for manipulating the spine.

The operation of the preferred embodiment of device 1 in accordance with the present invention for manipulating the spine of a user recumbent upon his back may be readily described. The linear reciprocation of drive shaft 205 by fluid cylinder 300 under power of pump 400 causes, through coupling occurring in the mechanical linkages of each of the thruster members 201-203, a linear reciprocal thrusting of the toroids 280, 283 against the back of the recumbent patient 2. This linear reciprocal thrusting is illustrated in FIGS. 5*a* and 5*b* by thruster member 203 operating against the cervical region of the spine of user 2. The thruster member 203 is shown in both the retracted position (FIG. 5*a*) and the extended position (FIG. 5*b*). The angle of the cervical region thrusting is 45°, which is the perferred angle for this region.

The manipulations performed by manipulation device 1, and the real time control of these manipulations, in accordance with the present invention are more subtle. The locations of the one or more sites of temporally coordinated thrustings relative to the longitudinal axis of the patient 2 are substantially determined by where the patient 2 lies upon the cushion 104 and how the upper frame 101 is moved relative to lower frame 102. The locations of the thrustings relative to the lateral axis of the patient's spine is determined by the side-to-side alignment of the patient's torso and back over the central aperture of cushion 104. This side-to-side alignment is primarily determined by where the user lies on cushion 104. The upper and lower frames 101, 102 may be locked relative to each other for the duration of the manipulating or, as is more common, may remain slidable relative to each other in order that the recumbent patient may, by pushing with his or her feet or arms, move his or her torso and spinal areas to a better position with respect to one or more of the ongoing thrusting manipulations.

The locations of the thrustor sites relative to each other may also be adjusted. The relocation of the bolted mounts 112-114 relative to lower frame 102, and the selection of a particular engagement slot within drive shaft 105 by a lever 263 (FIG. 4) of a thruster 201-203, permit a great latitude of precision adjustment. The manipulation device 1 is intended to be set up by a professional for the long term spinal therapy or exercise of a particular patient. The manipulation device 1 accommodates diverse patient heights, weights, and positions for spinal manipulation.

The area and pattern of the manipulations performed by the manipulation device 1 are also fully predeterminable, primarily by the extent, and type, of operative surfaces that are used upon the thrusters 201-203. The surfaces may be flat, or, as is preferred, convex. Normally the thruster surfaces are somewhat elongated along the length of the spine. Two such surfaces which bracket the spine are especially preferred. The spatial relationship, and separation, between the separate surfaces of an individual thruster 201-203 and between thrusters, may be selected as desired.

The amplitude of the thruster travel is determined by the construction of the mechanical linkage of each of the thrusters 201-203 and by the amount of reciprocal movement of drive shaft 205. The amplitude and end points are typically established so that the operative surfaces of each of the thrusters 201-203 reciprocate to a first position extending upwards from the bed's surface and to a second position wherein the thrusters are retracted downward below its surface. At this first position, the thrusters 201-203 make pressurized contact with a patient's back without inducing pain or substantially displacing the patient's torso, which remains recumbent upon the support bed 100. Retraction is normally sufficient so that the operative surfaces are no longer in contact with the patient's back. However, the retracted position is preferably distant enough from the patient's back so that a long rest period is experienced when the operative surface of the thruster is not in contact with the patient's back.

The amplitude of the thrusting motion is further variable and controllable for the manipulation device 1. The amplitude is adjustable by controlling the amplitude of reciprocation that fluid cylinder 300 induces in drive shaft 205. The amplitude of the reciprocation of drive shaft 205 is essentially determined by the amount of fluid that is circulated during each cycle of the pump 400 relative to the capacity of fluid cylinder 300. The amount of the fluid, typically air, that is within the system is easily controllable by bleeding fluid at low or high pressure points of the fluid flow. Accordingly, the amplitude of the thrusting is controllable through this means.

The frequency of the thrusting is determined by the cycle rate of the pump 400. This frequency is easily controllable by varying the electrical power that is provided to the electric drive motor of pump 400.

The total number of cycles that ensue during any one period of use of the manipulation device 1 is a function of the frequency of operation, which may be altered during the course of a session, and the length of such session. Both parameters are under direct control of the patient.

The pressure exerted by the thrusting manipulations can be increased if the recumbent patient 2 is restrained from moving during the thrustings. The patient 2 can support weights upon his or her chest or abdomen, or can be strapped to the support bed 100. Conversely, the pressure of the thrusting manipulations can be made very light by making the amplitude of such manipulations small, or by making the toroids 280, 283 out of resilient material such as foam rubber.

The angle of thrusting contact with the patient's back is predetermined by the relative dimensions, and ratios, of the legs of the triangularly-shaped mechanical linkage of each of the thrusters 201–203. The angle of thrusting is further adjustable by the selectable attachment of the third leg of each mechanical linkage at a variable position upon the reciprocating drive shaft. Alternatively, the third leg of a mechanical linkage of a thruster may be completely decoupled from the reciprocating drive shaft, thereby disabling that thruster in a recessed position. In this way, the manipulation device 1 can be configured to use only one or two thrusters at a time, in order to localize spinal manipulation treatment.

According to these parameters of operation which are variable, and which may be controlled in real time, the device in accordance with the present invention is extremely versatile in its operation. Once it is recognized that the parameters of device operation may be versatilely and accurately predetermined and controlled for extreme spinal conditions, it becomes obvious that the device can be set up, and used, to provide precision therapeutic regimens to many types of patients.

FIG. 6 shows that the inventive manipulation device 1 can be easily transported by providing a set of wheels 401 on one end of the device and using the side rails 106, 107 to roll the manipulation device 1 like a dolly.

The present invention is adaptable to further embodiments and purposes other than merely the preferred embodiment and purpose for manipulating the back and spine. For example, a device employing similar principles might be used to cyclicly massage the muscles of the legs or arms. Although the preferred embodiment of the device preferably operates on a recumbent user, a user could hold himself in contact with the thrusters of the device, or the device could be pressed from above into contact with a supine user. The device need not have exactly three thrusters, nor need it be suitable for use over the entire length of the human spine, as is the case with the preferred embodiment of the device. Rather, the device could be quite compact and could be suitable, for example, to apply a linear reciprocal thrusting force to the cervical region of the spine or to the neck muscles.

In accordance with these and other possible alterations and adaptations of the present invention, the present invention should be perceived broadly in accordance with the following claims.

What is claimed is:

1. An apparatus for manipulating a person's body comprising:

a. support means for supporting a person's body in a recumbent position; and b. thruster means for reciprocally thrusting upwards simultaneously towards a plurality of localized regions of said person's recumbent body at a predetermined angle of between about 45°–70° relative to the support means and for applying pressure thereto and for retracting downwards relative to the support means and relative to said person's body recumbent on said support means between a first position retracted into said support means and a second position extended above said support means.

2. The apparatus according to claim 1 wherein said support means comprises:

a. lower frame means, positionally fixed in a substantially level plane relative to the thruster means, for providing support; and b. upper frame means, supported on said lower frame means and positionally adjustable in a substantially level plane for supporting said person's body.

3. The apparatus according to claim 2 wherein the support means further comprises:

a. roller means between the lower frame means and the upper frame means for rolling along an axis within a substantially level plane in order to permit the positional adjustment of the upper frame means relative to the lower frame means.

4. The apparatus according to claim 1 wherein said thruster means comprises:

a. a mechanical arm means having a driving member for oscillating along an axis substantially spaced parallel to the longitudinal axis of the recumbent person's body;

b. a first linear member pivotably connected at one end to said driving member; and c. a second linear member pivotably connected at its first end to the remaining end of the first linear member and at its second end to the support means.

5. The apparatus according to claim 4 further comprising engagement means between the driving member and the first linear member for adjusting the point of connection between said driving member and said first linear member.

6. The apparatus according to claim 5 wherein the engagement means comprises a lever pivoting relative to said first linear member to selectively latch one of a plurality of slot means along said driving member.

7. The apparatus according to claim 4 wherein the amplitude of the oscillation of the driving member may be adjusted by varying the relative dimensions of the first and the second linear member.

8. The apparatus according to claim 4 further comprising:

a. adjusting means having a fluid cylinder for inducing oscillation of the driving member;

b. pump means for pumping pressurized fluid to the fluid cylinder; and c. a bleeder valve for controlling the amount of fluid that is pumped under pressure from said pump to said fluid cylinder.

9. The apparatus according to claim 4 further comprising means for adjusting the rate of the oscillation o the driving member.

10. The apparatus according to claim 9 wherein said means for adjusting comprises:

a. an electric motor for inducing the oscillation of the driving member at a rate determined by the magnitude of electrical power supplied to said motor; and
b. a rheostat for controllably supplying electrical power to said electric motor.

11. The apparatus according to claim 4 wherein the driving member comprises:
a. a linear driveshaft connected to the first member; and
b. motive means for oscillating the driveshaft.

12. The apparatus according to claim 11 wherein the motive means comprises a fluid cylinder connected to said driveshaft for providing oscillation in said driveshaft in response to the cyclical flow of pressurized fluid.

13. The apparatus according to claim 1 further adapted for manipulating the back of a user recumbent upon his or her back,
a. wherein said support means comprises a substantially horizontal top surface suitably sized and adapted to support a user recumbent upon his back, and defining a central aperture that is proximate to the spine of the recumbent user's torso; and
b. wherein the reciprocating thruster means comprises a mechanical linkage having at an uppermost location an operative region suitably sized and adapted to pass through the top surface's aperture in order to contact a portion of the recumbent user's spine.

14. The apparatus according to claim 13 wherein the mechanical linkage comprises:
a. a first linear member for pivoting at one end relative to the support means;
b. a second, driveshaft, linear member for linearly positionally reciprocating in a path substantially parallel to the recumbent user's torso; and
c. a third linear member pivotably connecting the second member to the other end of the first member;

wherein the pivotable connection of the first and the third members constitutes the uppermost operative region that is reciprocating relative to the top surface of the support means in order to provide relatively more, and relatively less, force against the portion of the user's spine.

15. The apparatus according to claim 14 wherein the mechanical linkage's operative region comprises a mass carried at the pivotable connection of the first and the third members, and sized and adapted contact an area of the user's back spanning less than three adjacent vertebrae of a user's spine.

16. The apparatus according to claim 15 wherein the mechanical linkage's operative region's mass comprises two regularly shaped geometric solid bodies having surfaces spaced parallel at a separation that permits each surface to contact an alternate side of a vertebrae of the user's spine.

17. The apparatus according to claim 16 wherein the mechanical linkage's two solid bodies comprise two toroids, and wherein the spaced parallel surfaces are an exterior arcuate segment of each of the two toroids.

18. The apparatus according to claim 1 adapted for manipulating the back of a user recumbent upon his back wherein the thruster means comprises a plurality of linearly positionally reciprocating mechanical arms each of which has an operative region sized and adapted to contact only a small area portion of the user's entire back.

19. An apparatus for simultaneously thrusting against the back of a user recumbent upon his back at a plurality of localized regions at a particular amplitude of applied thrusting force, the apparatus comprising:
a. a support bed presenting a surface upon which a user may lie back downwards;
b. a plurality of members at least partially within the support bed movable between a first position extending upwards from the support bed's surface and a second position retracted downwards into the support bed below its surface;
c. means for varying the reciprocating member's first position wherein the determination of the first position determines the spatial distance that the reciprocating member extends upwards from the support bed's surface; and
d. reciprocating means for moving said plurality of members from said second position to said first position at a predetermined angle of between about 45°–70° relative to the support bed.

20. The apparatus according to claim 19,
a. wherein the reciprocating member comprises a mechanical linkage substantially in the shape of a triangle open at one vertex having a first vertex positionally fixed relative to the support bed, having a second vertex positionally oscillating between greater and lessor proximity to the first vertex, and having a third vertex that positionally reciprocates relative to the support bed's surface between the first and second positions; and
b. wherein the means for varying comprises mechanical means for positionally oscillating
the linkage's second vertex relative to its
first vertex over a fixed distance; wherein the fixed distance of second vertex oscillation induces, by mechanical action of the mechanical linkage, a correspondingly fixed distance of third vertex reciprocation, and the fixed distance of the third vertex reciprocation varies the first position.

21. an apparatus for simultaneously thrusting against the back of a user recumbent upon his back at a plurality of localized regions of the user's back in order that the user's back between the localized regions may be manipulated by a slight bending while the user remains recumbent throughout, the apparatus comprising:
a. a support presenting a surface upon which a user may lie recumbent on his back; and
b. a plurality of reciprocating members each having an operative region sized and adapted to contact a localized region of said user's back, all said reciprocating members simultaneously reciprocating in coordination with each other and at an angle of between about 45°–70° relative to the support's surface between a first position where the operative region extends upwards from the support's surface and thrusts into forceful contact with the user'back, and a second position where the operative region retracts into the support substantially below its surface and exerts relatively less forceful contact with the user's back, wherein the plurality of reciprocating members are spaced apart, and exhibit an amplitude of reciprocation, so that their reciprocating operative regions, upon their coordinated movement from the second positions to the first position, forcibly thrust against localized regions of the user's back sufficiently so as to cause a slight bending of the user's back between the localized regions while the user remains recumbent.

22. The apparatus according to claim 21 particularly adapted for manipulating the spine by slight bending wherein the operative region of each of the plurality of reciprocating members comprises a pair of surfaces spaced parallel at a separation that brackets a spinal vertebrae.

23. The apparatus according to claim 22 wherein each of the pair of surfaces comprises an exterior surfaces of a toroid.

24. In a system having a machine for controllably manipulating a human's back and an improvement wherein the machine comprises:

a. bed means for supporting the human recumbent upon his back;

b. reciprocating means for positionally reciprocating relative to the bed means between a first position substantially retracted into the bed means underneath the human's back at a predetermined acute angle of between about 45°–70° relative to the bed means, and a second position extending above the bed means and into thrusting contact with the human's back; and c. first control means responsive to the human for controlling the amplitude of the positional reciprocation of the reciprocating means.

25. The improvement to said machine according to claim 24, a. wherein the reciprocating means comprises a mechanical finger actuated for movement by fluid pressure, and a pump connected to said mechanical finger, reciprocally pressurizing a fluid in order to cause the mechanical finger to positionally reciprocate between the first and the second positions; and b. wherein the first control means comprises means for controlling the amount of fluid that the pump reciprocally pressurizes, therein also controlling the amplitude of the positional reciprocation of the mechanical finger.

26. The improvement to said machine according to claim 24 further comprising second control means responsive to said human for controlling the frequency of the positional reciprocation of the reciprocating means.

27. The improvement according to claim 26, a. wherein the reciprocating means comprises a mechanical finger actuated for movement by fluid pressure, and a pump connected to said mechanical finger, reciprocally pressurizing a fluid in order to cause the mechanical finger to positionally reciprocate between the first and the second positions; and b. wherein the second control means comprises means for controlling the speed of the pump.

28. The improvement according to claim 24 wherein the reciprocating means comprises:

a. a mechanical linkage in a triangular shape defining an open first vertex, connected to only a first leg, that is positionally fixed relative to the bed means;

b. a second vertex, connected to a second and to a third leg, that oscillates between greater and lessor proximity to the first vertex; and c. a third vertex, connected to the first and to the third legs, that positionally reciprocates relative to the bed means between the first and the second position.

* * * * *